US010217412B2

(12) United States Patent
Hwang et al.

(10) Patent No.: US 10,217,412 B2
(45) Date of Patent: Feb. 26, 2019

(54) OLED DISPLAY DEVICE DRIVE SYSTEM AND OLED DISPLAY DRIVE METHOD

(71) Applicant: Shenzhen China Star Optoelectronics Technology Co., Ltd., Shenzhen (CN)

(72) Inventors: Taijiun Hwang, Shenzhen (CN); Pengfei Liang, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 229 days.

(21) Appl. No.: 15/121,033

(22) PCT Filed: Jun. 21, 2016

(86) PCT No.: PCT/CN2016/086540

§ 371 (c)(1),
(2) Date: Aug. 24, 2016

(87) PCT Pub. No.: WO2017/206205

PCT Pub. Date: Dec. 7, 2017

(65) Prior Publication Data

US 2018/0204516 A1 Jul. 19, 2018

(30) Foreign Application Priority Data

Jun. 2, 2016 (CN) ..... 2016 1 0388319

(51) Int. Cl.
*G09G 3/3258* (2016.01)
*G09G 3/3225* (2016.01)
*G09G 3/3233* (2016.01)

(52) U.S. Cl.
CPC ..... *G09G 3/3258* (2013.01); *G09G 3/3225* (2013.01); *G09G 3/3233* (2013.01); *G09G 2310/0264* (2013.01)

(58) Field of Classification Search
CPC ..... G09G 3/3208; G09G 2320/0233; G09G 3/3225; G09G 3/3233; G09G 3/3291;
(Continued)

(56) References Cited

U.S. PATENT DOCUMENTS

2010/0039422 A1* 2/2010 Seto ..... G09G 3/3233 345/212
2015/0061981 A1* 3/2015 Lee ..... G09G 3/3291 345/77

(Continued)

FOREIGN PATENT DOCUMENTS

CN 102222468 A 10/2011
CN 105280140 A 1/2016
CN 105321455 A 2/2016

*Primary Examiner* — Koosha Sharifi-Tafreshi
(74) *Attorney, Agent, or Firm* — Leong C. Lei

(57) ABSTRACT

Provided are an OLED display device drive system and an OLED display device drive method. The OLED display device drive system introduces the common voltage signal (Vcm) in the threshold voltage detection circuit (2) into the sub pixel driving circuit (1), and in the writing stage, by applying the common voltage signal (Vcm) to the organic light emitting diode (D1), the organic light emitting diode is in the negative voltage and reverse biased, and then in the light emitting stage, the common voltage signal (Vcm) is removed from the organic light emitting diode (D1), and then the trans-voltage of the organic light emitting diode (D1) changes from the negative voltage to the positive voltage and the light is normally emitted. Thus, the organic light emitting diode (D1) has been through the positive and negative alternating current drive, and can delay the aging of the OLED and extend the OLED lifetime.

10 Claims, 8 Drawing Sheets

(58) Field of Classification Search
CPC ..... G09G 2320/0295; G09G 2320/045; G09G 2300/0819; G09G 2320/029; G09G 2320/043; G09G 3/3258
See application file for complete search history.

(56) References Cited

U.S. PATENT DOCUMENTS

2015/0379909 A1* 12/2015 Yu ..... G09G 3/006 345/690
2017/0154573 A1* 6/2017 Woo ..... G09G 3/3283

* cited by examiner

OLED DISPLAY DEVICE DRIVE SYSTEM AND OLED DISPLAY DRIVE METHOD

FIELD OF THE INVENTION

The present invention relates to a display technology field, and more particularly to an OLED display device drive system and an OLED display drive method.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types according to the driving methods, which are the Passive Matrix OLED (PMOLED) and the Active Matrix OLED (AMOLED), i.e. two types of the direct addressing and the Thin Film Transistor (TFT) matrix addressing. The AMOLED comprises pixels arranged in array and belongs to active display type, which has high lighting efficiency and is generally utilized for the large scale display devices of high resolution.

The AMOLED is a current driving element. When the electrical current flows through the organic light emitting diode, the organic light emitting diode emits light, and the brightness is determined according to the current flowing through the organic light emitting diode itself. Most of the present Integrated Circuits (IC) only transmit voltage signals. Therefore, the AMOLED pixel driving circuit needs to accomplish the task of converting the voltage signals into the current signals. The traditional AMOLED pixel driving circuit generally is 2T1C, which is a structure comprising two thin film transistors and one capacitor to convert the voltage into the current.

As shown in FIG. 1, which is a 2T1C pixel driving circuit employed for AMOLED, comprising a first thin film transistor T10, a second thin film transistor T20, a first capacitor C10 and an organic light emitting diode D10. The first thin film transistor T10 is a switch thin film transistor, and the second thin film transistor T20 is a drive thin film transistor, and the capacitor C10 is a storage capacitor. Specifically, a gate of the first thin film transistor T10 is electrically coupled to the scan signal Scan, and a source is electrically coupled to the data signal Data, and a source electrically coupled to the first node A; a gate of the second thin film transistor T20 is electrically coupled to the first node A, and a source is electrically coupled to power source voltage Ovdd, and a drain is electrically coupled to the second node B; an anode of the organic light emitting diode D10 is electrically coupled to the second node B, and a cathode is grounded; one end of the first capacitor C10 is electrically coupled to the first node, and the other end is electrically coupled to the second node B. Besides, a parasitic capacitance C20 is further formed at the two ends of the organic light emitting diode D10, and the parasitic capacitance C20 is coupled with the two ends of the organic light emitting diode D10 in parallel. As the AMOLED displays, the scan signal Scan controls the first thin film transistor T10 to be activated, and the data signal Data enters the gate of the second thin film transistor T20 and the first capacitor C10 via the first thin film transistor T10. Then, the first thin film transistor T10 is deactivated. With the storage function of the first capacitor C10, the gate voltage of the second thin film transistor T20 can remain to hold the data signal voltage to make the second thin film transistor T20 to be in the conducted state to drive the current to enter the organic light emitting diode D10 via the second thin film transistor T20 and to drive the organic light emitting diode D10 to emit light.

In the aforesaid OLED pixel driving method, the organic light emitting diode D10 is constantly in the aging state, and the aging levels of all the pixels are not consistent, and result in the phenomenon of image sticking to shorten the lifetime of the organic light emitting diode and to influence the display quality of the OLED display device.

SUMMARY OF THE INVENTION

An objective of the present invention is to provide an OLED display device drive system, which can delay the aging of the OLED and extend the OLED lifetime.

Another objective of the present invention is to provide an OLED display device drive method, which can delay the aging of the OLED and extend the OLED lifetime.

For realizing the aforesaid objectives, the present invention provides an OLED display device drive system, comprising: a sub pixel driving circuit and a threshold voltage detection circuit electrically coupled to the sub pixel driving circuit; wherein the sub pixel driving circuit comprises: a first thin film transistor, a second thin film transistor, a third thin film transistor, a first capacitor and an organic light emitting diode;

the threshold voltage detection circuit comprises: a first switch and a second switch;

a gate of the first thin film transistor receives a scan pulse signal, a source receives a data signal, and a drain is electrically coupled to a first node;

a gate of the second thin film transistor is electrically coupled to the first node, and a source receives a direct current voltage signal, and a drain is electrically coupled to a second node;

a gate of the third thin film transistor receives a detection pulse signal, and a source is electrically coupled to a third node, and a drain is electrically coupled to the second node;

one end of the first capacitor is electrically coupled to the first node, and the other end is electrically coupled to the second node;

an anode of the organic light emitting diode is electrically coupled to the second node, and a cathode is grounded;

one end of the first switch receives a common voltage signal, and the other end is electrically coupled to a fourth node;

one end of the second switch is electrically coupled to the fourth node, and the other end is electrically coupled to the third node.

The threshold voltage detection circuit further comprises: a third switch, a fourth switch, a third capacitor, an operational amplifier, a voltage storage circuit and an analog-to-digital converter;

one end of the third switch is electrically coupled to the third node, and the other end is electrically coupled to a fifth node;

an inverting input end of the operational amplifier is electrically coupled to the fifth node, and a non-inverting input end is electrically coupled to the fourth node, and an output end is electrically coupled to an input end of the voltage storage circuit;

one end of the fourth switch is electrically coupled to the fifth node, and the other end is electrically coupled to the output end of the operational amplifier;

one end of the third capacitor is electrically coupled to the fifth node, and the other end is electrically coupled to the output end of the operational amplifier;

the output end of the voltage storage circuit is electrically coupled to the analog-to-digital converter.

As the OLED display device shows images, the first switch and the second switch are off, and the source of the third thin film transistor receives the common voltage signal.

As the OLED display device shows images, the scan pulse signal, the detection pulse signal and the data signal are combined with one another to correspond to a writing stage and a light emitting stage one after another.

In the writing stage, the scan pulse signal and the detection pulse signal control the first thin film transistor and the third thin film transistor to be on, and the data signal is outputted to the first node, and the common voltage signal is outputted to the second node, and the organic light emitting diode is reverse biased;

in the light emitting stage, the scan pulse signal and the detection pulse signal control the first thin film transistor and the third thin film transistor to be off, and the second thin film transistor is on, and the organic light emitting diode normally emits light.

A parasitic capacitance is further formed in the sub pixel driving circuit, and the parasitic capacitance is coupled with two ends of the organic light emitting diode in parallel.

The present invention further provides an OLED display device drive method, comprising steps of:

step 1, providing an OLED display device drive system, comprising a sub pixel driving circuit and a threshold voltage detection circuit electrically coupled to the sub pixel driving circuit; wherein the sub pixel driving circuit comprises: a first thin film transistor, a second thin film transistor, a third thin film transistor, a first capacitor and an organic light emitting diode;

the threshold voltage detection circuit comprises: a first switch and a second switch;

a gate of the first thin film transistor receives a scan pulse signal, a source receives a data signal, and a drain is electrically coupled to a first node;

a gate of the second thin film transistor is electrically coupled to the first node, and a source receives a direct current voltage signal, and a drain is electrically coupled to a second node;

a gate of the third thin film transistor receives a detection pulse signal, and a source is electrically coupled to a third node, and a drain is electrically coupled to the second node;

one end of the first capacitor is electrically coupled to the first node, and the other end is electrically coupled to the second node;

an anode of the organic light emitting diode is electrically coupled to the second node, and a cathode is grounded;

one end of the first switch receives a common voltage signal, and the other end is electrically coupled to a fourth node;

one end of the second switch is electrically coupled to the fourth node, and the other end is electrically coupled to the third node;

step 2, starting to drive the OLED display device to show images, and entering a writing stage;

wherein the first switch and the second switch are off, and the scan pulse signal and the detection pulse signal control the first thin film transistor and the third thin film transistor to be on, and the data signal is outputted to the first node, and the common voltage signal is outputted to the second node, and the organic light emitting diode is reverse biased;

step 3, entering a light emitting stage;

in the light emitting stage, the scan pulse signal and the detection pulse signal control the first thin film transistor and the third thin film transistor to be off, and the second thin film transistor is on, and the organic light emitting diode normally emits light.

The threshold voltage detection circuit further comprises: a third switch, a fourth switch, a third capacitor, an operational amplifier, a voltage storage circuit and an analog-to-digital converter;

one end of the third switch is electrically coupled to the third node, and the other end is electrically coupled to a fifth node;

an inverting input end of the operational amplifier is electrically coupled to the fifth node, and a non-inverting input end is electrically coupled to the fourth node, and an output end is electrically coupled to an input end of the voltage storage circuit;

one end of the fourth switch is electrically coupled to the fifth node, and the other end is electrically coupled to the output end of the operational amplifier;

one end of the third capacitor is electrically coupled to the fifth node, and the other end is electrically coupled to the output end of the operational amplifier;

the output end of the voltage storage circuit is electrically coupled to the analog-to-digital converter.

The OLED display device drive method further comprises a step of detecting the threshold voltage to the OLED display device before the step 2.

A parasitic capacitance is further formed in the sub pixel driving circuit, and the parasitic capacitance is coupled with two ends of the organic light emitting diode in parallel.

The present invention further provides an OLED display device drive system, comprising: a sub pixel driving circuit and a threshold voltage detection circuit electrically coupled to the sub pixel driving circuit; wherein the sub pixel driving circuit comprises: a first thin film transistor, a second thin film transistor, a third thin film transistor, a first capacitor and an organic light emitting diode;

the threshold voltage detection circuit comprises: a first switch and a second switch;

a gate of the first thin film transistor receives a scan pulse signal, a source receives a data signal, and a drain is electrically coupled to a first node;

a gate of the second thin film transistor is electrically coupled to the first node, and a source receives a direct current voltage signal, and a drain is electrically coupled to a second node;

a gate of the third thin film transistor receives a detection pulse signal, and a source is electrically coupled to a third node, and a drain is electrically coupled to the second node;

one end of the first capacitor is electrically coupled to the first node, and the other end is electrically coupled to the second node;

an anode of the organic light emitting diode is electrically coupled to the second node, and a cathode is grounded;

one end of the first switch receives a common voltage signal, and the other end is electrically coupled to a fourth node;

one end of the second switch is electrically coupled to the fourth node, and the other end is electrically coupled to the third node;

wherein the threshold voltage detection circuit further comprises: a third switch, a fourth switch, a third capacitor, an operational amplifier, a voltage storage circuit and an analog-to-digital converter;

one end of the third switch is electrically coupled to the third node, and the other end is electrically coupled to a fifth node;

an inverting input end of the operational amplifier is electrically coupled to the fifth node, and a non-inverting input end is electrically coupled to the fourth node, and an output end is electrically coupled to an input end of the voltage storage circuit;

one end of the fourth switch is electrically coupled to the fifth node, and the other end is electrically coupled to the output end of the operational amplifier;

one end of the third capacitor is electrically coupled to the fifth node, and the other end is electrically coupled to the output end of the operational amplifier;

the output end of the voltage storage circuit is electrically coupled to the analog-to-digital converter;

wherein a parasitic capacitance is further formed in the sub pixel driving circuit, and the parasitic capacitance is coupled with two ends of the organic light emitting diode in parallel.

The benefits of the present invention are: in the OLED display device drive system provided by the present invention, by introducing the common voltage signal in the threshold voltage detection circuit into the sub pixel driving circuit, and in the writing stage, by applying the common voltage signal to the organic light emitting diode, the organic light emitting diode is in the negative voltage and reverse biased, and then in the light emitting stage, the common voltage signal is removed from the organic light emitting diode, and then the trans-voltage of the organic light emitting diode changes from the negative voltage to the positive voltage and the light is normally emitted. Thus, as refreshing every frame of image, the organic light emitting diode has been through the positive and negative alternating current drive, and it can delay the aging of the OLED and extend the OLED lifetime. The OLED display device drive method provided by the present invention can delay the aging of the OLED and extend the OLED lifetime.

BRIEF DESCRIPTION OF THE DRAWINGS

In order to better understand the characteristics and technical aspect of the invention, please refer to the following detailed description of the present invention is concerned with the diagrams, however, provide reference to the accompanying drawings and description only and is not intended to be limiting of the invention.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
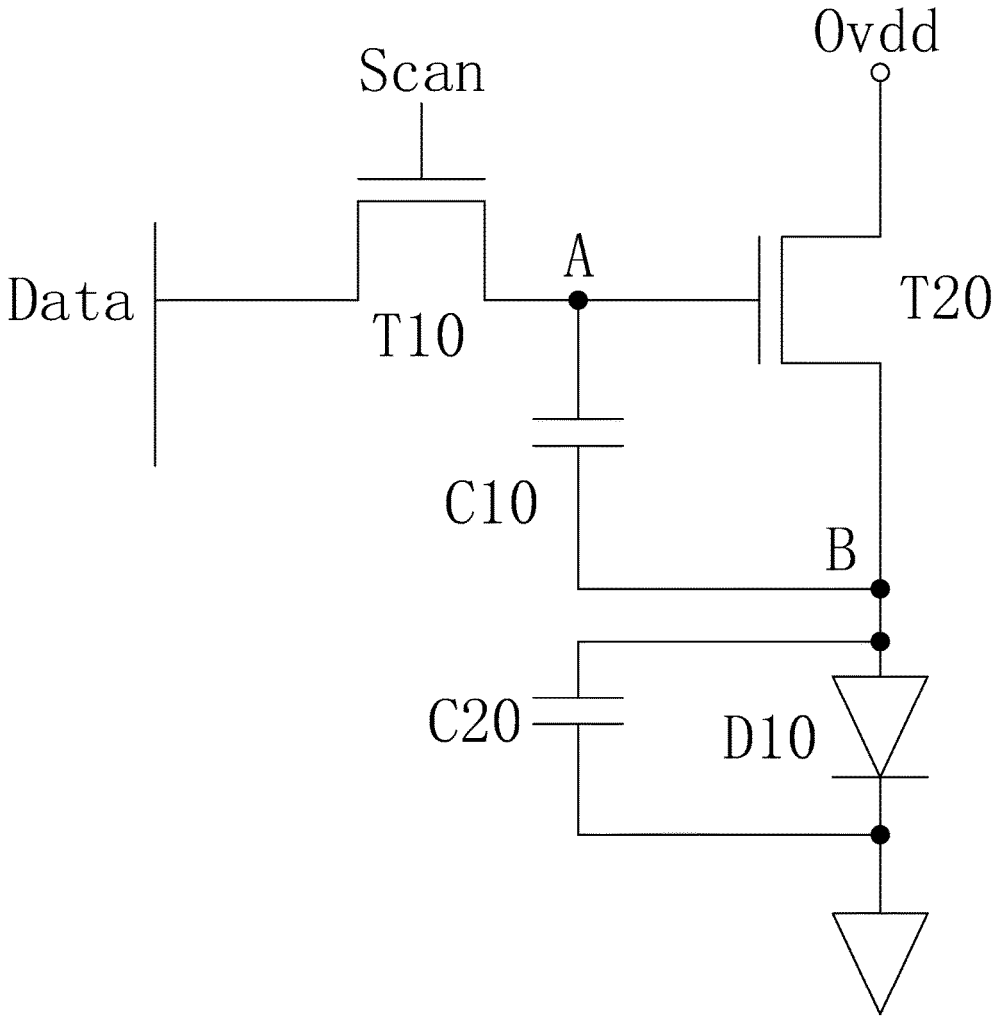
(Prior Art) Fig. 1
FIG. 1 is a circuit diagram of a pixel driving circuit in an OLED display device according to prior art.
Figure 2:
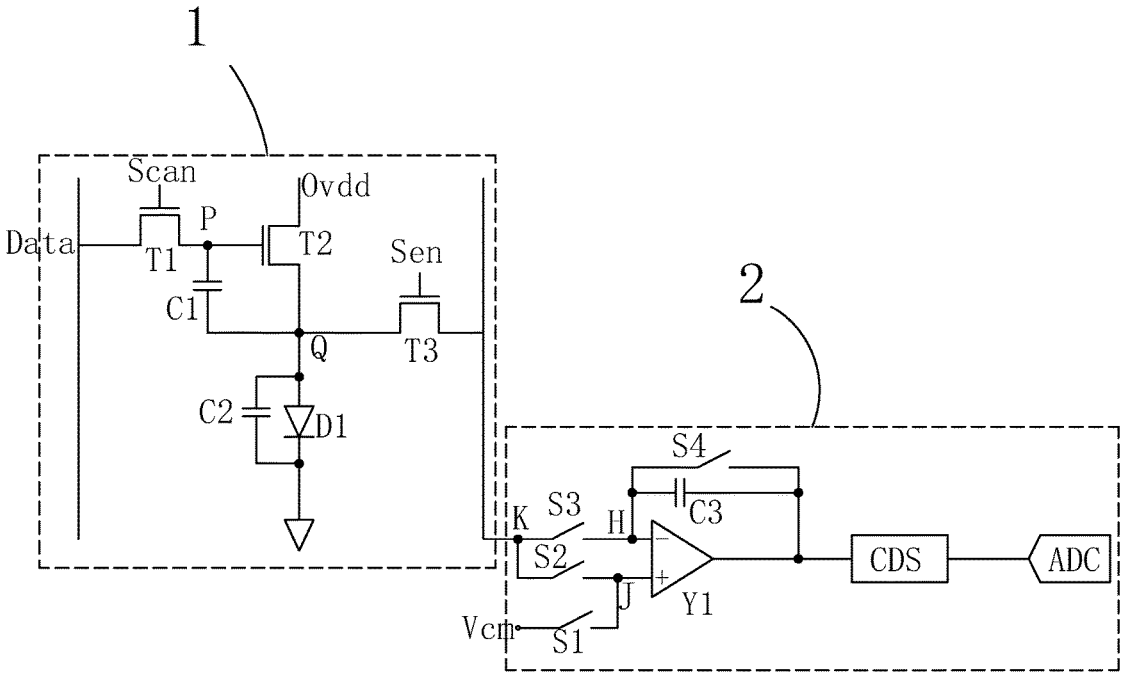
FIG. 2 is a circuit diagram of the OLED display device drive system according to the present invention.

Please refer to FIG. 2. The present invention first provides an OLED display device drive system, comprising: a sub pixel driving circuit 1 and a threshold voltage detection circuit 2 electrically coupled to the sub pixel driving circuit 1; wherein the sub pixel driving circuit 1 comprises: a first thin film transistor T1, a second thin film transistor T2, a third thin film transistor T3, a first capacitor C1 and an organic light emitting diode D1;

the threshold voltage detection circuit 2 comprises: a first switch S1 and a second switch S2, a third switch S3, a fourth switch S4, a third capacitor C3, an operational amplifier Y1, a voltage storage circuit CDS and an analog-to-digital converter ADC;

a gate of the first thin film transistor T1 receives a scan pulse signal Scan, a source receives a data signal Data, and a drain is electrically coupled to a first node P;

a gate of the second thin film transistor T2 is electrically coupled to the first node P, and a source receives a direct current voltage signal Ovdd, and a drain is electrically coupled to a second node Q;

a gate of the third thin film transistor T3 receives a detection pulse signal Sen, and a source is electrically coupled to a third node K, and a drain is electrically coupled to the second node Q;

one end of the first capacitor C1 is electrically coupled to the first node P, and the other end is electrically coupled to the second node Q;

an anode of the organic light emitting diode D1 is electrically coupled to the second node Q, and a cathode is grounded;

one end of the first switch S1 receives a common voltage signal Vcm, and the other end is electrically coupled to a fourth node J;

one end of the second switch S2 is electrically coupled to the fourth node J, and the other end is electrically coupled to the third node K;

one end of the third switch S3 is electrically coupled to the third node K, and the other end is electrically coupled to a fifth node H;

an inverting input end of the operational amplifier Y1 is electrically coupled to the fifth node H, and a non-inverting input end is electrically coupled to the fourth node J, and an output end is electrically coupled to an input end of the voltage storage circuit CDS;

one end of the fourth switch S4 is electrically coupled to the fifth node H, and the other end is electrically coupled to the output end of the operational amplifier Y1;

one end of the third capacitor C3 is electrically coupled to the fifth node H, and the other end is electrically coupled to the output end of the operational amplifier Y1;

the output end of the voltage storage circuit CDS is electrically coupled to the analog-to-digital converter ADC.

Specifically, a parasitic capacitance C2 is further formed in the sub pixel driving circuit 1, and the parasitic capacitance C2 is coupled with two ends of the organic light emitting diode D1 in parallel.

Figure 3:
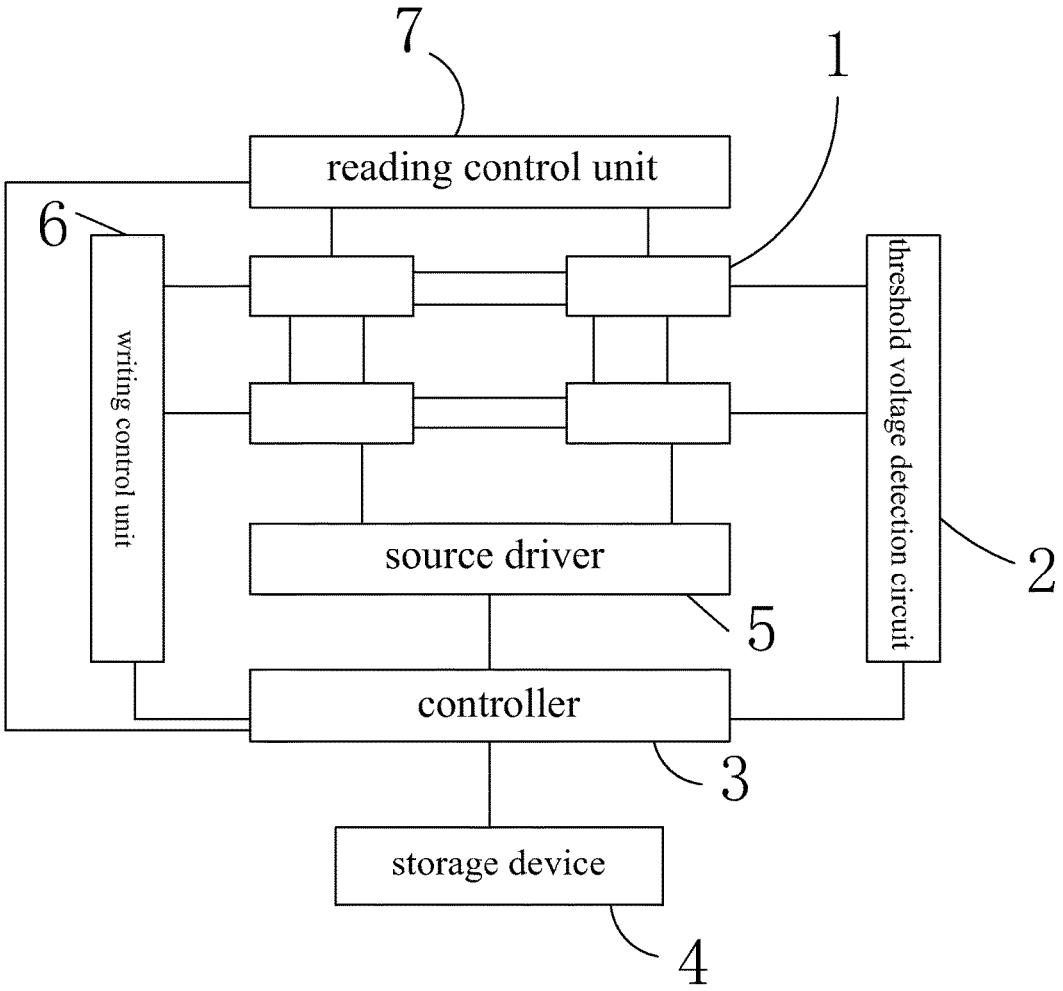
FIG. 3 is a structure diagram of the OLED display device drive system according to the present invention.

Specifically, referring to FIG. 3, the OLED display device drive system according to the present invention is established based on the following the OLED display device structure. The OLED display device structure comprises: a plurality of sub pixel circuits 1 aligned in array, a threshold voltage detection circuit 2 electrically coupled to all the plurality of sub pixel circuits 1, a controller 3 electrically coupled to the threshold voltage detection circuit 2, a storage device 4 electrically coupled to the controller 3, a source driver 5 electrically to both the controller 3 and the plurality of sub pixel circuits 1, a writing control unit 6 electrically coupled to both the controller 3 and the plurality of sub pixel circuits 1, and a reading control unit 7 electrically coupled to both the controller 3 and the plurality of sub pixel circuits 1. The source driver 5 is employed to provide the data signal Data to the plurality of sub pixel circuits 1. The threshold voltage detection circuit 2 is employed to detect the threshold voltages of the drive thin film transistors (i.e. the second thin film transistors T2) and the organic light emitting diode D1 in the plurality of sub pixel circuits 1, and forms the threshold voltage data of digital signal format to be stored in the storage device 4. The controller 3 is employed to control the source driver 5 to adjust the data signal Data according to the threshold voltage data stored in the storage device 4 to make the brightnesses of the organic light emitting diode D1 in the plurality of sub pixel circuits 1 constant.

Specifically, after the OLED display device first accomplishes the detection for the threshold voltages of the drive thin film transistors and the organic light emitting diode in the sub pixel circuits 1, the OLED display device is driven to show images. As showing images, all the first switch S1, the second switch S2 and the fourth switch S4 are on, and the third switch S3 is off, and the source of the third thin film transistor T3 receives the common voltage signal Vcm.

Furthermore, as the OLED display device shows every frame of image, it comprises two stages, the writing stage and the light emitting stage one after another, which respectively correspond to different states of scan pulse signal Scan, the detection pulse signal Sen and the data signal Data.

Figure 4:
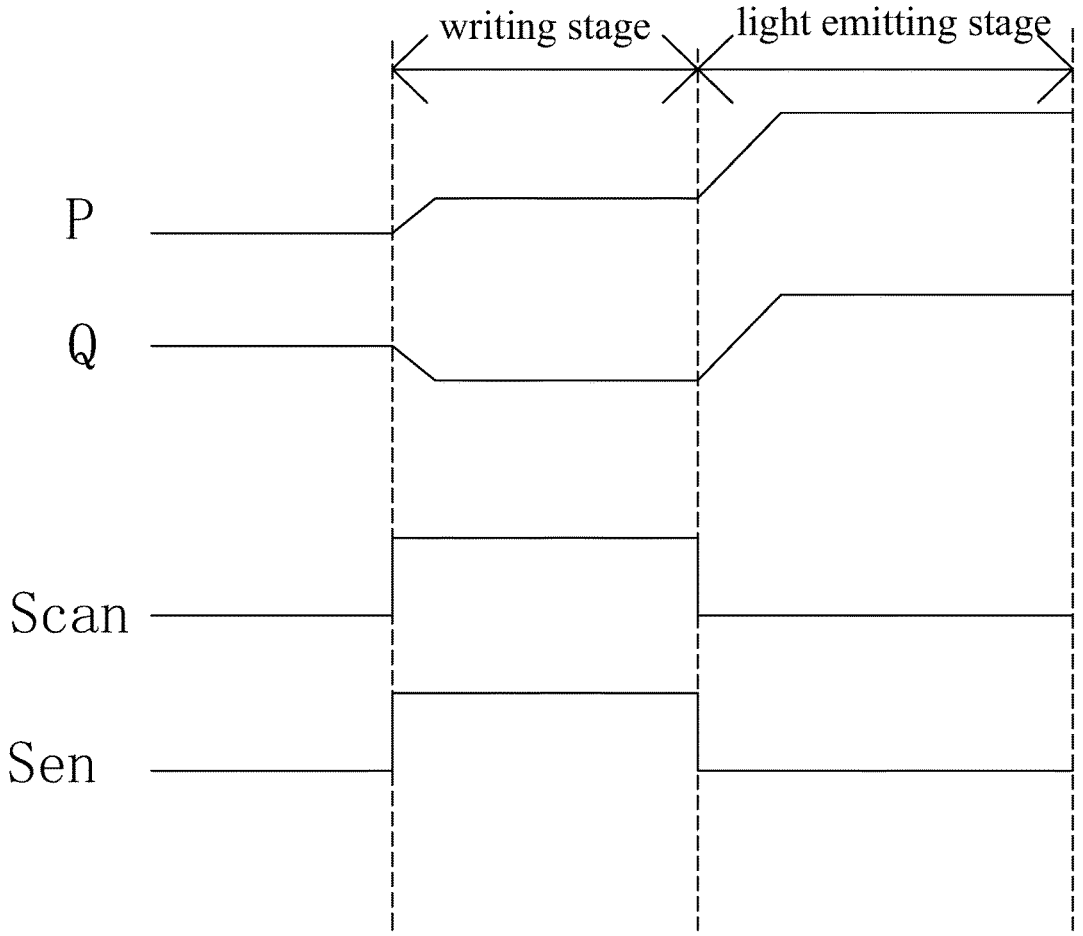
FIG. 4 is a sequence diagram of the OLED display device drive system according to the present invention.
Figure 6:
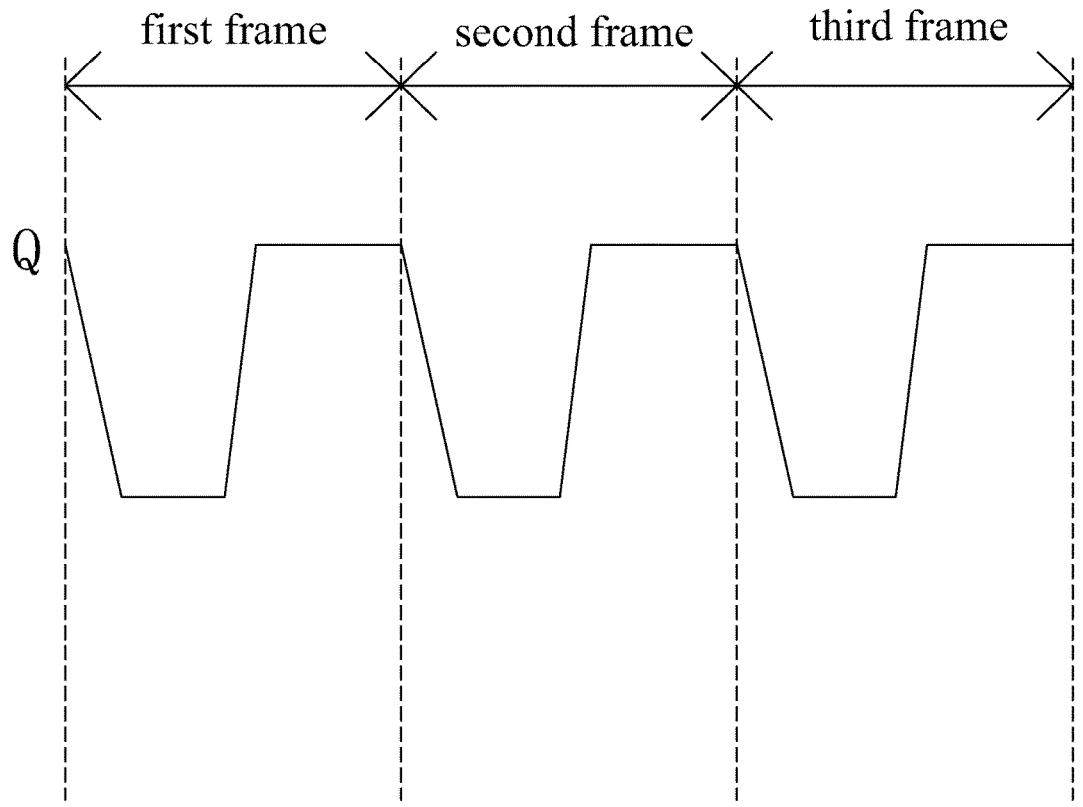
FIG. 6 is a voltage level waveform diagram of the second node as the OLED display device drive system according to the present invention shows static images.
Figure 7:
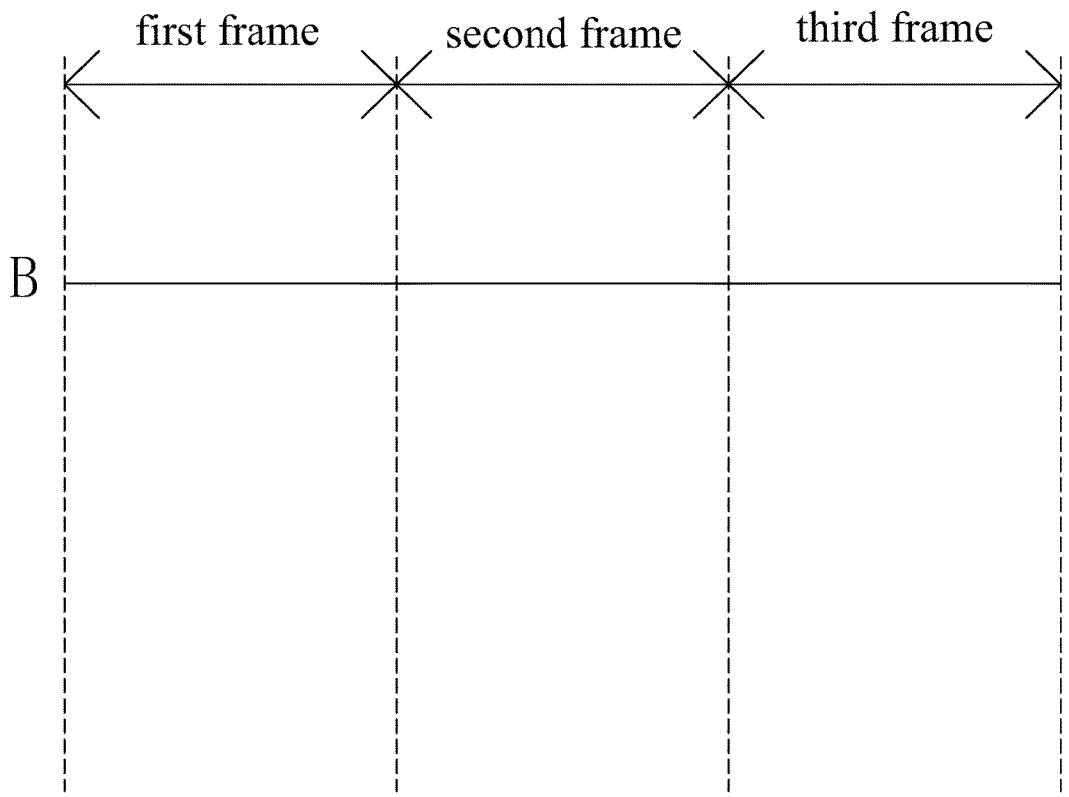
FIG. 7 is a voltage level waveform diagram of the second node as the pixel driving circuit the an OLED display device shown in FIG. 1 shows static images.

Specifically, referring to FIG. 4 with combination of FIG. 2, in the writing stage, the scan pulse signal Scan and the detection pulse signal Sen control the first thin film transistor T1 and the third thin film transistor T3 to be on, and the data signal Data is outputted to the first node P, and the common voltage signal Vcm is outputted to the second node Q, and the organic light emitting diode D1 is reverse biased. In the light emitting stage, the scan pulse signal Scan and the detection pulse signal Sen control the first thin film transistor T1 and the third thin film transistor T3 to be off, and the second thin film transistor T2 is on, and the organic light emitting diode D1 normally emits light. Comparing FIG. 4 and FIG. 5, it can be found that in comparison with prior art, the voltage of the two ends of the organic light emitting diode D1 in the OLED display device drive system according to the present invention has been through one voltage drop and one voltage boost from the writing stage to the light emitting stage. With combination of FIG. 6 and FIG. 7, namely, as the present invention drive the OLED display device to show every frame of image, the organic light emitting diode D1 is first reverse biased, i.e. in the negative voltage and then normally emits light, i.e. in the positive voltage. That is to say, as the OLED display device shows every frame of image, all the organic light emitting diodes D1 have been through the positive and negative alternating current drive, and thus, it can delay the aging of the OLED and extend the OLED lifetime.

Selectably, all the first thin film transistor T1, the second thin film transistor T2 and the third thin film transistor T3 are N type thin film transistors. In the writing stage 1, both the scan pulse signal Scan and the detection pulse signal Sen provide high voltage levels, and in the light emitting stage 2, both the scan pulse signal Scan and the detection pulse signal Sen provide low voltage levels.

Figure 8:
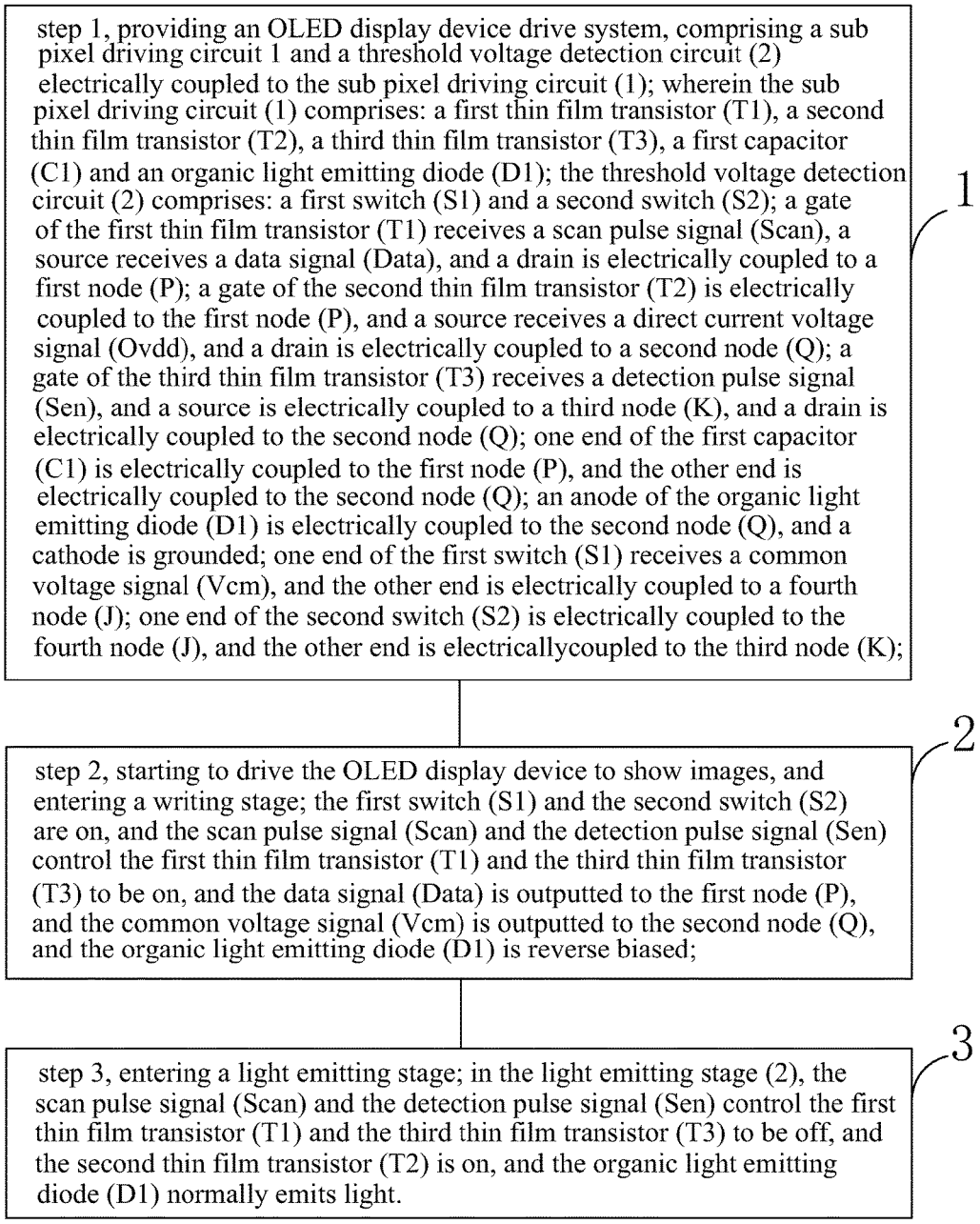
FIG. 8 is a flowchart of the OLED display device drive method according to the present invention.

Please refer to FIG. 8, the present invention further provides an OLED display device drive method, comprising steps of:

step 1, providing an OLED display device drive system, comprising a sub pixel driving circuit 1 and a threshold voltage detection circuit 2 electrically coupled to the sub pixel driving circuit 1; wherein the sub pixel driving circuit 1 comprises: a first thin film transistor T1, a second thin film transistor T2, a third thin film transistor T3, a first capacitor C1 and an organic light emitting diode D1;

the threshold voltage detection circuit 2 comprises: a first switch S1 and a second switch S2;

a gate of the first thin film transistor T1 receives a scan pulse signal Scan, a source receives a data signal Data, and a drain is electrically coupled to a first node P;

a gate of the second thin film transistor T2 is electrically coupled to the first node P, and a source receives a direct current voltage signal Ovdd, and a drain is electrically coupled to a second node Q;

a gate of the third thin film transistor T3 receives a detection pulse signal Sen, and a source is electrically coupled to a third node K, and a drain is electrically coupled to the second node Q;

one end of the first capacitor C1 is electrically coupled to the first node P, and the other end is electrically coupled to the second node Q;

an anode of the organic light emitting diode D1 is electrically coupled to the second node Q, and a cathode is grounded;

one end of the first switch S1 receives a common voltage signal Vcm, and the other end is electrically coupled to a fourth node J;

one end of the second switch S2 is electrically coupled to the fourth node J, and the other end is electrically coupled to the third node K;

Specifically, the threshold voltage detection circuit 2 further comprises: a third switch S3, a fourth switch S4, a third capacitor C3, an operational amplifier Y1, a voltage storage circuit CDS and an analog-to-digital converter ADC; one end of the third switch S3 is electrically coupled to the third node K, and the other end is electrically coupled to a fifth node H; an inverting input end of the operational amplifier Y1 is electrically coupled to the fifth node H, and a non-inverting input end is electrically coupled to the fourth node J, and an output end is electrically coupled to an input end of the voltage storage circuit CDS; one end of the fourth switch S4 is electrically coupled to the fifth node H, and the other end is electrically coupled to the output end of the operational amplifier Y1; one end of the third capacitor C3 is electrically coupled to the fifth node H, and the other end is electrically coupled to the output end of the operational amplifier Y1; the output end of the voltage storage circuit CDS is electrically coupled to the analog-to-digital converter ADC.

step 2, referring to FIG. 4, starting to drive the OLED display device to show images, and entering a writing stage;

all the first switch S1, the second switch S2 and the fourth switch S4 are on, and the third switch S3 is off, and the scan pulse signal Scan and the detection pulse signal Sen control the first thin film transistor T1 and the third thin film transistor T3 to be on, and the data signal Data is outputted to the first node P, and the common voltage signal Vcm is outputted to the second node Q, and the organic light emitting diode D1 is reverse biased;

step 3, referring to FIG. 4, entering a light emitting stage;

in the light emitting stage 2, the scan pulse signal Scan and the detection pulse signal Sen control the first thin film transistor T1 and the third thin film transistor T3 to be off, and the second thin film transistor T2 is on, and the organic light emitting diode D1 normally emits light.

Selectably, all the first thin film transistor T1, the second thin film transistor T2 and the third thin film transistor T3 are N type thin film transistors. In the writing stage 1, both the scan pulse signal Scan and the detection pulse signal Sen provide high voltage levels, and in the light emitting stage 2, both the scan pulse signal Scan and the detection pulse signal Sen provide low voltage levels.

Figure 5:
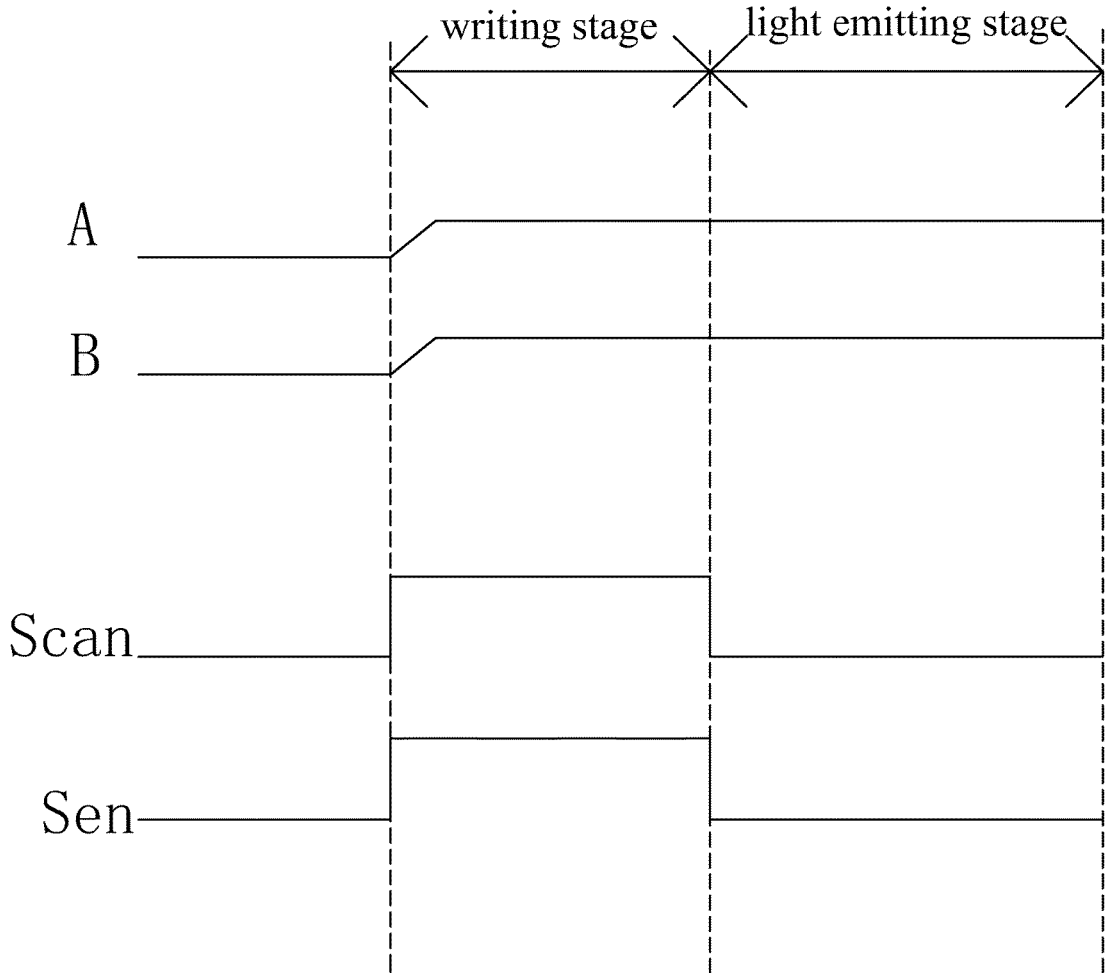
FIG. 5 is a sequence diagram corresponding to the pixel driving circuit the an OLED display device shown in FIG. 1.

Significantly, comparing FIG. 4 and FIG. 5, it can be found that in comparison with prior art, the voltage of the two ends of the organic light emitting diode D1 in the OLED display device drive method according to the present invention has been through one voltage drop and one voltage boost from the writing stage to the light emitting stage. With combination of FIG. 6 and FIG. 7, namely, as the present invention drive the OLED display device to show every frame of image, the organic light emitting diode D1 is first reverse biased, i.e. in the negative voltage and then normally emits light, i.e. in the positive voltage. That is to say, as the OLED display device shows every frame of image, all the organic light emitting diodes D1 have been through the positive and negative alternating current drive, and thus, it can delay the aging of the OLED and extend the OLED lifetime.

In conclusion, in the OLED display device drive system provided by the present invention, by introducing the common voltage signal in the threshold voltage detection circuit into the sub pixel driving circuit, and in the writing stage, by applying the common voltage signal to the organic light emitting diode, the organic light emitting diode is in the negative voltage and reverse biased, and then in the light emitting stage, the common voltage signal is removed from the organic light emitting diode, and then the trans-voltage of the organic light emitting diode changes from the negative voltage to the positive voltage and the light is normally emitted. Thus, as refreshing every frame of image, the organic light emitting diode has been through the positive and negative alternating current drive, and it can delay the aging of the OLED and extend the OLED lifetime. The OLED display device drive method provided by the present invention can delay the aging of the OLED and extend the OLED lifetime.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An OLED display device drive system, comprising: a sub pixel driving circuit and a threshold voltage detection circuit electrically coupled to the sub pixel driving circuit; wherein the sub pixel driving circuit comprises: a first thin film transistor, a second thin film transistor, a third thin film transistor, a first capacitor and an organic light emitting diode;

the threshold voltage detection circuit comprises: a first switch and a second switch;

a gate of the first thin film transistor receives a scan pulse signal, a source receives a data signal, and a drain is electrically coupled to a first node;

a gate of the second thin film transistor is electrically coupled to the first node, and a source receives a direct current voltage signal, and a drain is electrically coupled to a second node;

a gate of the third thin film transistor receives a detection pulse signal, and a source is electrically coupled to a third node, and a drain is electrically coupled to the second node;

one end of the first capacitor is electrically coupled to the first node, and the other end is electrically coupled to the second node;

an anode of the organic light emitting diode is electrically coupled to the second node, and a cathode is grounded;

one end of the first switch receives a common voltage signal, and the other end is electrically coupled to a fourth node;

one end of the second switch is electrically coupled to the fourth node, and the other end is electrically coupled to the third node;

wherein in a writing stage, the scan pulse signal and the detection pulse signal control the first thin film transistor and the third thin film transistor to be on, respectively, and the data signal is outputted to the first node, and the common voltage signal is outputted to the second node, and the organic light emitting diode is reverse biased;

in a light emitting stage, the scan pulse signal and the detection pulse signal control the first thin film transistor and the third thin film transistor to be off, and the second thin film transistor is on, and the organic light emitting diode normally emits light.

2. The OLED display device drive system according to claim 1, wherein the threshold voltage detection circuit further comprises: a third switch, a fourth switch, a third capacitor, an operational amplifier, a voltage storage circuit and an analog-to-digital converter;

one end of the third switch is electrically coupled to the third node, and the other end is electrically coupled to a fifth node;

an inverting input end of the operational amplifier is electrically coupled to the fifth node, and a non-inverting input end is electrically coupled to the fourth node, and an output end is electrically coupled to an input end of the voltage storage circuit;

one end of the fourth switch is electrically coupled to the fifth node, and the other end is electrically coupled to the output end of the operational amplifier;

one end of the third capacitor is electrically coupled to the fifth node, and the other end is electrically coupled to the output end of the operational amplifier;

the output end of the voltage storage circuit is electrically coupled to the analog-to-digital converter.

3. The OLED display device drive system according to claim 1, wherein as the OLED display device shows images, the first switch and the second switch are on, and the source of the third thin film transistor receives the common voltage signal.

4. The OLED display device drive system according to claim 1, wherein a parasitic capacitance is further formed in the sub pixel driving circuit, and the parasitic capacitance is coupled with two ends of the organic light emitting diode in parallel.

5. An OLED display device drive method, comprising steps of:

step 1, providing an OLED display device drive system, comprising a sub pixel driving circuit and a threshold voltage detection circuit electrically coupled to the sub pixel driving circuit; wherein the sub pixel driving circuit comprises: a first thin film transistor, a second thin film transistor, a third thin film transistor, a first capacitor and an organic light emitting diode;

the threshold voltage detection circuit comprises: a first switch and a second switch;

a gate of the first thin film transistor receives a scan pulse signal, a source receives a data signal, and a drain is electrically coupled to a first node;

a gate of the second thin film transistor is electrically coupled to the first node, and a source receives a direct current voltage signal, and a drain is electrically coupled to a second node;

a gate of the third thin film transistor receives a detection pulse signal, and a source is electrically coupled to a third node, and a drain is electrically coupled to the second node;

one end of the first capacitor is electrically coupled to the first node, and the other end is electrically coupled to the second node;

an anode of the organic light emitting diode is electrically coupled to the second node, and a cathode is grounded;

one end of the first switch receives a common voltage signal, and the other end is electrically coupled to a fourth node;

one end of the second switch is electrically coupled to the fourth node, and the other end is electrically coupled to the third node;

step 2, starting to drive the OLED display device to show images, and entering a writing stage;

wherein the first switch and the second switch are on, and the scan pulse signal and the detection pulse signal control the first thin film transistor and the third thin film transistor to be on, respectively, and the data signal is outputted to the first node, and the common voltage signal is outputted to the second node, and the organic light emitting diode is reverse biased;

step 3, entering a light emitting stage;

in the light emitting stage, the scan pulse signal and the detection pulse signal control the first thin film transistor and the third thin film transistor to be off, and the second thin film transistor is on, and the organic light emitting diode normally emits light.

6. The OLED display device drive method according to claim 5, wherein the threshold voltage detection circuit further comprises: a third switch, a fourth switch, a third capacitor, an operational amplifier, a voltage storage circuit and an analog-to-digital converter;

one end of the third switch is electrically coupled to the third node, and the other end is electrically coupled to a fifth node;

an inverting input end of the operational amplifier is electrically coupled to the fifth node, and a non-inverting input end is electrically coupled to the fourth node, and an output end is electrically coupled to an input end of the voltage storage circuit;

one end of the fourth switch is electrically coupled to the fifth node, and the other end is electrically coupled to the output end of the operational amplifier;

one end of the third capacitor is electrically coupled to the fifth node, and the other end is electrically coupled to the output end of the operational amplifier;

the output end of the voltage storage circuit is electrically coupled to the analog-to-digital converter.

7. The OLED display device drive method according to claim 6, further comprising a step of detecting the threshold voltage to the OLED display device before the step 2.

8. The OLED display device drive method according to claim 5, wherein a parasitic capacitance is further formed in the sub pixel driving circuit, and the parasitic capacitance is coupled with two ends of the organic light emitting diode in parallel.

9. An OLED display device drive system, comprising: a sub pixel driving circuit and a threshold voltage detection circuit electrically coupled to the sub pixel driving circuit; wherein the sub pixel driving circuit comprises: a first thin film transistor, a second thin film transistor, a third thin film transistor, a first capacitor and an organic light emitting diode;

the threshold voltage detection circuit comprises: a first switch and a second switch;

a gate of the first thin film transistor receives a scan pulse signal, a source receives a data signal, and a drain is electrically coupled to a first node;

a gate of the second thin film transistor is electrically coupled to the first node, and a source receives a direct current voltage signal, and a drain is electrically coupled to a second node;

a gate of the third thin film transistor receives a detection pulse signal, and a source is electrically coupled to a third node, and a drain is electrically coupled to the second node;

one end of the first capacitor is electrically coupled to the first node, and the other end is electrically coupled to the second node;

an anode of the organic light emitting diode is electrically coupled to the second node, and a cathode is grounded;

one end of the first switch receives a common voltage signal, and the other end is electrically coupled to a fourth node;

one end of the second switch is electrically coupled to the fourth node, and the other end is electrically coupled to the third node;

wherein the threshold voltage detection circuit further comprises: a third switch, a fourth switch, a third capacitor, an operational amplifier, a voltage storage circuit and an analog-to-digital converter;

one end of the third switch is electrically coupled to the third node, and the other end is electrically coupled to a fifth node;

an inverting input end of the operational amplifier is electrically coupled to the fifth node, and a non-inverting input end is electrically coupled to the fourth node, and an output end is electrically coupled to an input end of the voltage storage circuit;

one end of the fourth switch is electrically coupled to the fifth node, and the other end is electrically coupled to the output end of the operational amplifier;

one end of the third capacitor is electrically coupled to the fifth node, and the other end is electrically coupled to the output end of the operational amplifier;

the output end of the voltage storage circuit is electrically coupled to the analog-to-digital converter;

wherein a parasitic capacitance is further formed in the sub pixel driving circuit, and the parasitic capacitance is coupled with two ends of the organic light emitting diode in parallel;

wherein in a writing stage, the scan pulse signal and the detection pulse signal control the first thin film transistor and the third thin film transistor to be on, respectively, and the data signal is outputted to the first node, and the common voltage signal is outputted to the second node, and the organic light emitting diode is reverse biased;

in a light emitting stage, the scan pulse signal and the detection pulse signal control the first thin film transistor and the third thin film transistor to be off, and the second thin film transistor is on, and the organic light emitting diode normally emits light.

10. The OLED display device drive system according to claim 9, wherein as the OLED display device shows images, the first switch and the second switch are on, and the source of the third thin film transistor receives the common voltage signal.

* * * * *